US008151428B2

(12) United States Patent
Dickerson, Jr. et al.

(10) Patent No.: US 8,151,428 B2
(45) Date of Patent: Apr. 10, 2012

(54) METHOD AND APPARATUS FOR CONTROLLING A MODE SHIFTER IN A WASHING MACHINE FROM A MOTOR CONTROLLER

(75) Inventors: Donald R. Dickerson, Jr., Louisville, KY (US); Michael Finch, Louisville, KY (US); William Bicknell, Louisville, KY (US); Robert Hollenbeck, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 959 days.

(21) Appl. No.: 11/498,123

(22) Filed: Aug. 1, 2006

(65) Prior Publication Data

US 2008/0041114 A1 Feb. 21, 2008

(51) Int. Cl.
*B23P 11/00* (2006.01)
*D06F 21/00* (2006.01)

(52) U.S. Cl. ..... 29/428; 68/133

(58) Field of Classification Search ..... 68/131, 68/133

See application file for complete search history.

(56) References Cited

U.S. PATENT DOCUMENTS 2,422,395 A * 6/1947 Kendall ..... 477/9
2,813,413 A * 11/1957 Leach ..... 68/12.21
2,909,050 A * 10/1959 Leach ..... 68/12.21
2,950,612 A * 8/1960 Henshaw, Jr. ..... 68/12.19
3,062,030 A * 11/1962 Groves ..... 68/12.18
3,087,321 A * 4/1963 Brucken ..... 68/23.6
3,248,909 A * 5/1966 Knerr ..... 68/12.05
3,463,285 A * 8/1969 Sisler ..... 192/104 R
3,772,925 A * 11/1973 Sisson ..... 74/82
4,000,968 A * 1/1977 Schrage et al. ..... 8/158
4,025,883 A * 5/1977 Slade et al. ..... 335/16
4,255,952 A 3/1981 Johnson
4,317,343 A 3/1982 Gerry
4,371,067 A 2/1983 Gerry
4,749,933 A * 6/1988 ben-Aaron ..... 318/810
4,946,012 A * 8/1990 Foster ..... 477/206
4,950,918 A * 8/1990 O'Breartuin et al. ..... 327/109
5,006,744 A * 4/1991 Archer et al. ..... 310/89
5,042,276 A * 8/1991 Kamano et al. ..... 68/12.04
5,778,703 A 7/1998 Imai et al.
5,810,111 A * 9/1998 Takeuchi et al. ..... 180/443
5,926,887 A * 7/1999 Thompson et al. ..... 8/159
6,189,171 B1 * 2/2001 Savkar et al. ..... 8/159
6,479,916 B1 * 11/2002 Bobay et al. ..... 310/89
6,516,485 B1 2/2003 Savkar et al.
6,834,407 B2 12/2004 Stephens
6,989,616 B2 * 1/2006 Okubo et al. ..... 310/64

(Continued)

FOREIGN PATENT DOCUMENTS

DE 35 13 155 * 10/1986

(Continued)

*Primary Examiner* — Frankie L Stinson
(74) *Attorney, Agent, or Firm* — Global Patent Operation; Douglas D. Zhang

(57) ABSTRACT

A method for assembling a washing machine is provided. The method includes providing a mode shifter including a solenoid, coupling a basket and an agitator to the mode shifter, and coupling a motor to the mode shifter. The solenoid selectively allows the motor to rotate at least one of the basket and the agitator. The method also includes affixing a motor controller to the motor, and electrically coupling the motor controller to each of the mode shifter and the motor. The motor controller is in operational control communication with the mode shifter and the motor.

20 Claims, 10 Drawing Sheets

U.S. PATENT DOCUMENTS

| | | | | |
|---|---|---|---|---|
| 7,047,770 | B2 | 5/2006 | Broker et al. | |
| 7,352,092 | B2 * | 4/2008 | Levine et al. | 310/71 |
| 7,462,965 | B2 * | 12/2008 | Natsuhara et al. | 310/64 |
| 2005/0120759 | A1 | 6/2005 | Choi et al. | |
| 2006/0208582 | A1 * | 9/2006 | Marioni | 310/68 R |

FOREIGN PATENT DOCUMENTS

| | | | |
|---|---|---|---|
| DE | 197 23 664 | * | 12/1997 |
| JP | 04-362321 | * | 12/1992 |
| JP | 07-000672 | * | 1/1995 |
| JP | 2001-000775 | * | 1/2001 |
| JP | 2001-000779 | * | 1/2001 |
| JP | 2001-017778 | * | 1/2001 |
| JP | 2001-300187 | * | 10/2001 |
| JP | 2001-340685 | * | 12/2001 |
| JP | 2003-284894 | * | 10/2003 |
| JP | 2004-209132 | * | 7/2004 |

* cited by examiner

METHOD AND APPARATUS FOR CONTROLLING A MODE SHIFTER IN A WASHING MACHINE FROM A MOTOR CONTROLLER

BACKGROUND OF THE INVENTION

This invention relates generally to washing machines and, more particularly, to methods and apparatus for controlling a mode shifter in a washing machine.

At least some known washing machines include a motor and a mode shifter. The mode shifter couples the motor through a pulley system to an agitator and/or a basket housed within the washing machine to selectively operate the agitator and/or the basket. Typically, the motor and the mode shifter draw power from separate power sources. Specifically, the motor is powered by a motor controller that is housed at or near a washing machine control board. A plurality of wires extend through the washing machine cabinet to electrically couple the motor controller to a power source, e.g., an electric outlet, through a power cord positioned at a lower corner of the washing machine cabinet. Further, the mode shifter is powered by an electromechanical timer or a washing machine control board positioned in a washing machine backsplash, which requires additional wires that extend through the washing machine cabinet to the mode shifter positioned at the lower corner of the washing machine cabinet. Such wires and/or electrical couplings require added manufacturing costs and/or may promote undesirable electrical coupling problems.

In addition, at least some known washing machine mode shifters are powered by an alternating current voltage. As such, the mode shifter receives a constant amount of power. Because some mode shifters always operate at a constant power, the alternating current voltage may cause the mode shifter to overheat. As a result, the washing machine may not operate properly and/or become inoperable.

BRIEF DESCRIPTION OF THE INVENTION

In one aspect, a method for assembling a washing machine is provided. The method includes providing a mode shifter including a solenoid, coupling a basket and an agitator to the mode shifter, and coupling a motor to the mode shifter. The solenoid selectively allows the motor to rotate at least one of the basket and the agitator. The method also includes affixing a motor controller to the motor, and electrically coupling the motor controller to each of the mode shifter and the motor. The motor controller is in operational control communication with the mode shifter and the motor.

In another aspect, a washing machine is provided. The washing machine includes a mode shifter including a solenoid, a basket and an agitator coupled to the mode shifter, and a motor coupled to the mode shifter. The solenoid selectively allows the motor to rotate at least one of the basket and the agitator. The washing machine also includes a motor controller affixed to the motor. The motor controller is electrically coupled to each of the mode shifter and the motor. The motor controller is configured to control operation of the mode shifter and the motor.

In a further aspect, an electronic configuration for a washing machine is provided. The electronic configuration includes a mode shifter including a solenoid. The mode shifter is coupled to each of a basket and an agitator. The electronic configuration also includes a motor coupled to the mode shifter. The solenoid selectively allows the motor to rotate at least one of the basket and the agitator. The electronic configuration also includes a motor controller affixed to the motor to reduce wiring in the washing machine. The motor controller is electrically coupled to the mode shifter and the motor. The motor controller is configured to control operation of the mode shifter and the motor.

DETAILED DESCRIPTION OF THE INVENTION

The present invention provides a method and apparatus for reducing wiring required to electrically couple components housed within a washing machine. In one embodiment, a motor controller is electrically coupled to a motor and a mode shifter housed within the washing machine. By coupling the motor controller to the motor and the mode shifter, additional wiring is not required to electrically couple a washing machine control board to the motor and the mode shifter. Further, affixing the motor controller to a top portion of the motor reduces an amount of wire that extends between the motor controller and the motor and the mode shifter. In a particular embodiment, the motor controller is configured to provide a pulse width modulated direct current voltage to the mode shifter for facilitating limiting power received by the mode shifter to a necessary amount of power to prevent or limit mode shifter overheating.

The present invention is described below in reference to its application in connection with and operation of a washing machine. However, it will be apparent to those skilled in the art and guided by the teachings herein provided that the invention is likewise applicable to any suitable electrical and/or electronic appliance.

Figure 1:
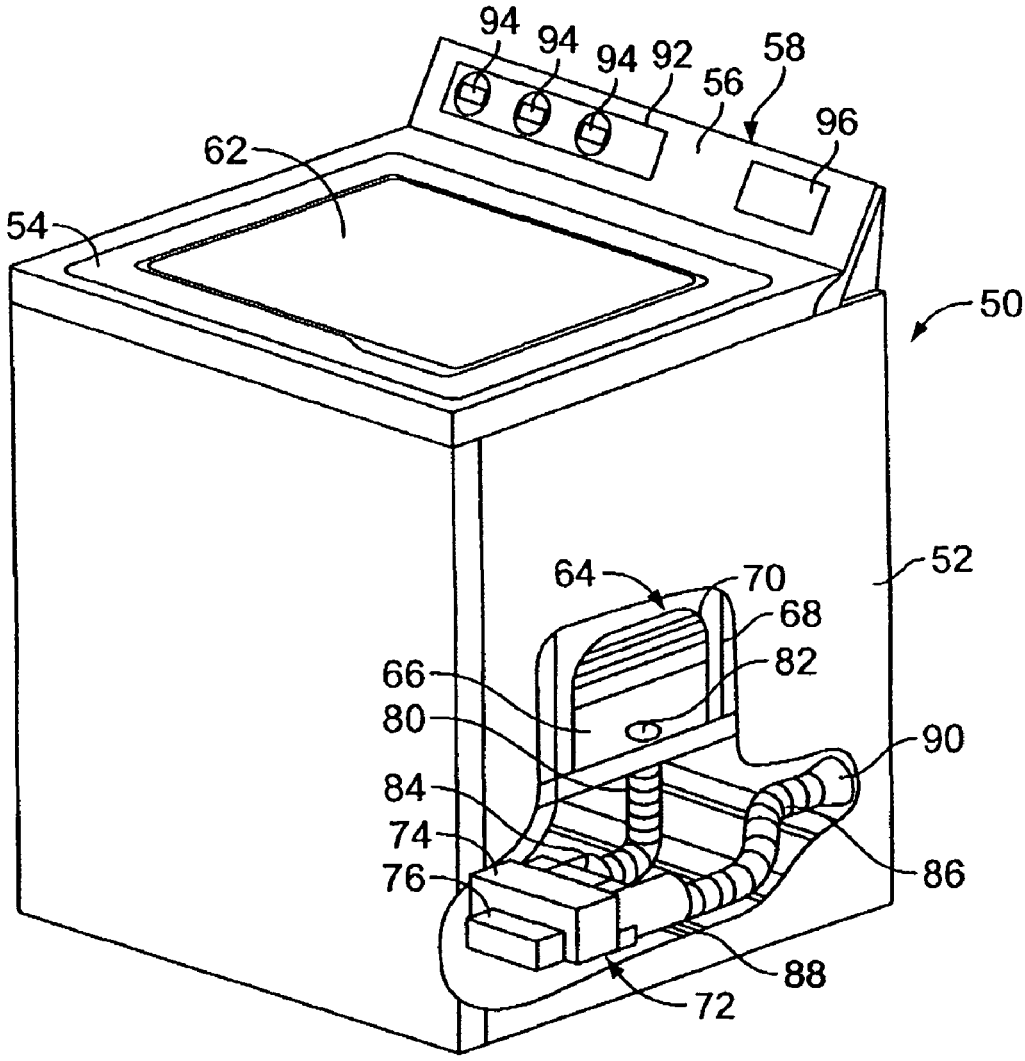
FIG. 1 is a perspective view of an exemplary washing machine with a portion of a washing machine cabinet removed.

FIG. 1 is a perspective view of an exemplary washing machine 50 including a cabinet 52 and a cover 54. A portion of cabinet 52 is removed to show material features and/or components of washing machine 50. A backsplash 56 extends from cover 54, and a washing machine control board assembly 58 is coupled to backsplash 56. A lid 62 is mounted to cover 54 and is movable between an open position (not shown) facilitating access to a wash tub 64 located within cabinet 52, and a closed position (shown in FIG. 1) forming a sealed enclosure over wash tub 64.

Wash tub 64 includes a bottom wall 66, a sidewall 68, and a basket 70 rotatably mounted within wash tub 64. A pump assembly 72 is located beneath wash tub 64 and basket 70 for gravity assisted flow when draining wash tub 64. Pump assembly 72 includes a pump 74 and a motor 76. A pump inlet hose 80 extends from a wash tub outlet 82 in bottom wall 66 to a pump inlet 84, and a pump outlet hose 86 extends from a pump outlet 88 to a water outlet 90 and ultimately to a building plumbing system discharge line (not shown) in flow communication with water outlet 90.

Further, in the exemplary embodiment, washing machine control board assembly 58 includes a control panel 92 and a plurality of input selectors 94, which collectively form a user interface input for operator selection of machine cycles and/or features. In one embodiment, a display 96 indicates selected features, a countdown timer, and/or other items of interest to machine users.

Figure 2:
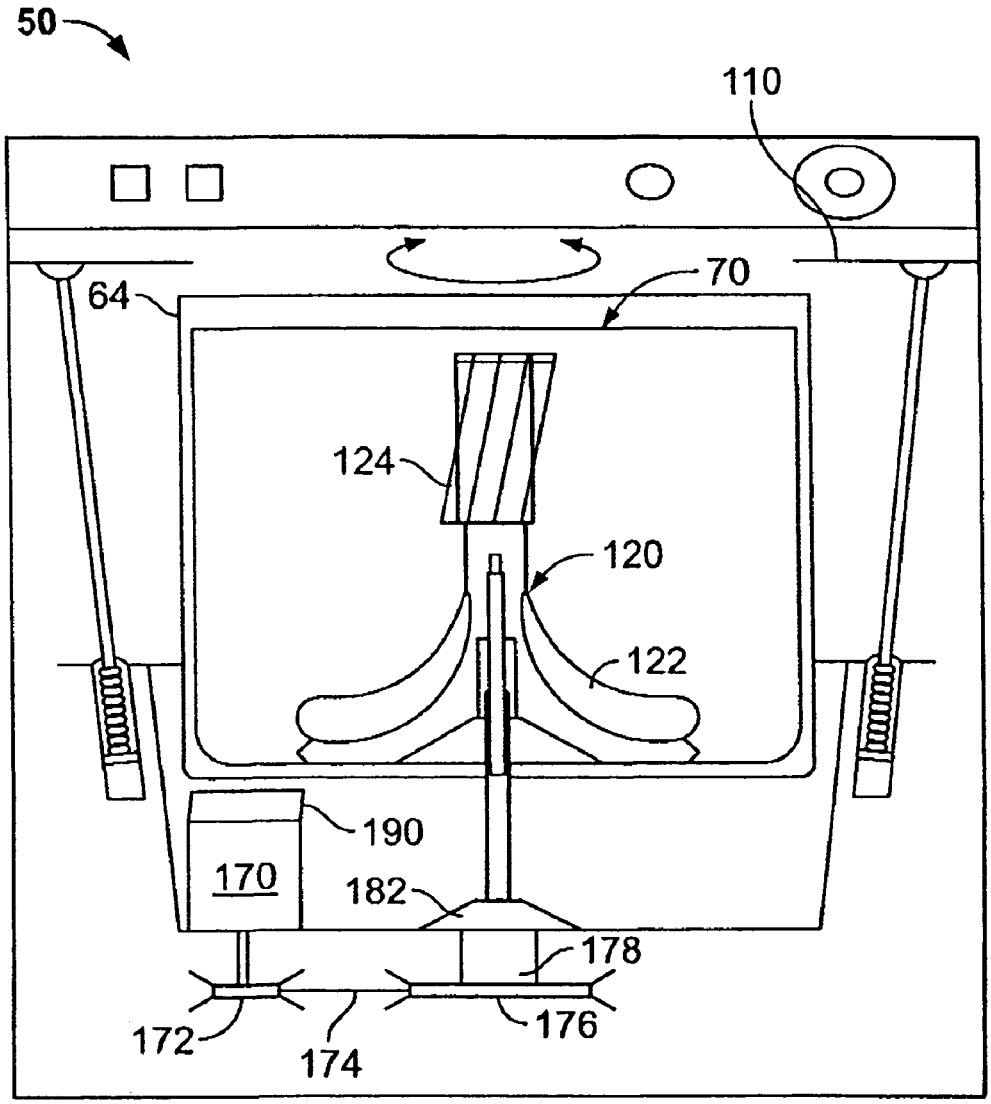
FIG. 2 is a schematic sectional view of the washing machine shown in FIG. 1.

FIG. 2 is a schematic view of washing machine 50. Washing machine 50 includes a frame 110 for supporting the components of the washing machine 50, basket 70 for holding articles such as clothes to be washed, and an agitator 120 for agitating the clothes in basket 70. In one embodiment, agitator 120 is molded with a plastic material, such as polypropylene, and includes a plurality of vanes 122. Vanes 122, which are typically flexible, mechanically agitate the clothes back and forth within the basket. In a particular embodiment, washing machine 50 includes an auger 124 at the top of agitator 120. Auger 124 further enhances the movement of the clothes within basket 70. Basket 70 and agitator 120 sit within wash tub 64, which retains the wash water during the wash cycle.

To power washing machine 50 a motor 170, such as a 3-phase motor, is provided. Motor 170 is coupled to the basket 70 and agitator 120 through a motor pulley 172, a belt 174, a drive pulley 176, a mode shifter 178, and basket and agitator drive shafts. Mode shifter 178 enables motor 170 to execute an agitation mode and a spin mode.

A motor controller 190 is affixed to a top portion of motor 170. In the exemplary embodiment, motor controller 190 is independently electrically coupled to motor 170 and mode shifter 178 for facilitating providing power to and operating motor 170 and/or mode shifter 178. Motor controller 190 is also electrically coupled to washing machine control board assembly 58 such that input into washing machine control board assembly 58 manipulates or controls operation of motor 170 and/or mode shifter 178. Because motor controller 190 is coupled to motor 170, the present invention facilitates reducing wiring within washing machine 50. Specifically, only the wires that electrically couple washing machine control board assembly 58 to motor controller 190 are required to extend from washing machine control board assembly 58 to a lower portion of washing machine 50. Further, the amount of wire needed to electrically couple motor controller 190 to motor 170 and mode shifter 178 is reduced. As such, an amount of wiring throughout washing machine 50 is reduced.

Mode shifter 178 includes an inductive power solenoid, described in detail below, which enables motor 170 to execute an agitation mode and a spin mode. In one embodiment, during the agitation mode, mode shifter 178 is energized to couple motor 170 to agitator 120. As such, only agitator 120 is rotated during the agitation mode. Further, during the spin mode, mode shifter 178 is deenergized to couple both basket 70 and agitator 120 to motor 170. As such, agitator 120 and basket 70 are rotated during the spin mode.

Figure 3:
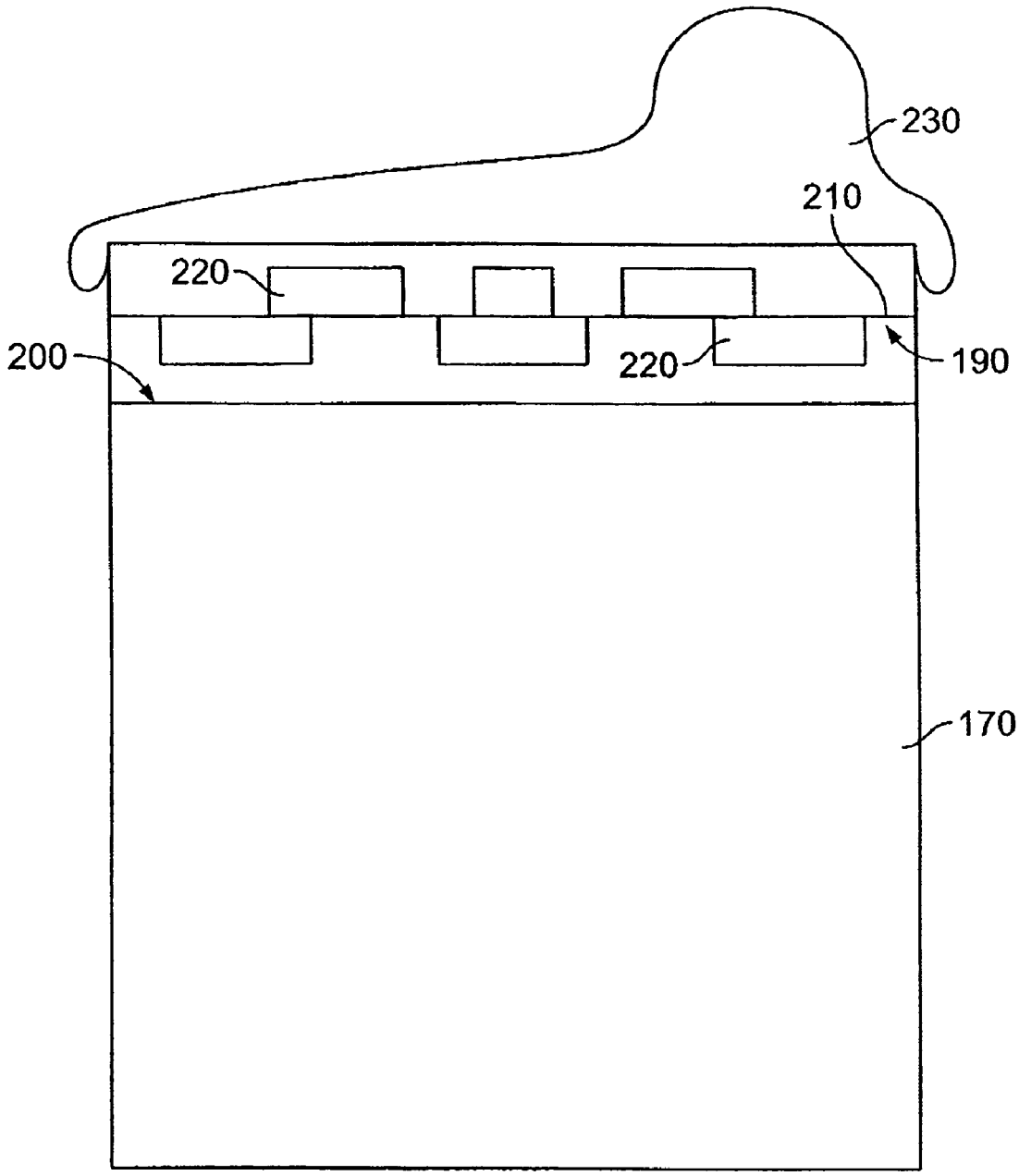
FIG. 3 is an exemplary embodiment of the motor shown in FIG. 2 and coupled to the motor controller shown in FIG. 2.

FIG. 3 is an exemplary embodiment of motor 170 affixed to motor controller 190. In one embodiment, motor controller 190 is affixed to a top portion 200 of motor 170. In this embodiment, motor 170 is a 3-phase motor. In alternative embodiments, motor 170 is any motor suitable for operating washing machine 50 as described herein. Motor controller 190 includes a circuit board 210 having a plurality of electronic components 220 coupled thereto, as described in greater detail below in reference to FIG. 10. A shield 230 is coupled to motor controller 190 and acts as a heat sink for motor controller 190. Further, shield 230 prevents or limits water within washing machine 50 from contacting motor controller 190.

Figure 4:
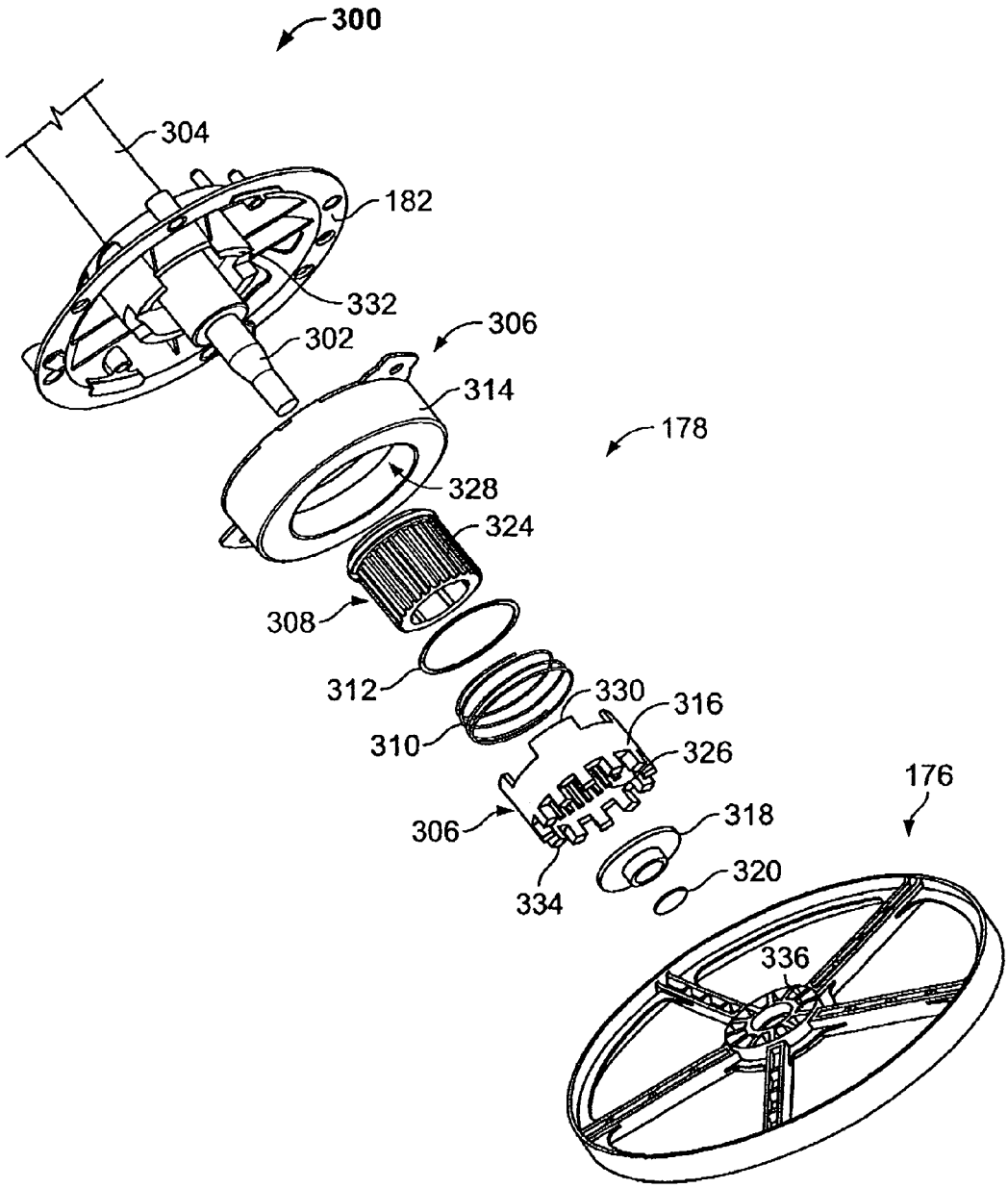
FIG. 4 is an exploded perspective view of the mode shifter shown in FIG. 2 coupled to a shaft assembly and the pulley shown in FIG. 2.
Figure 5:
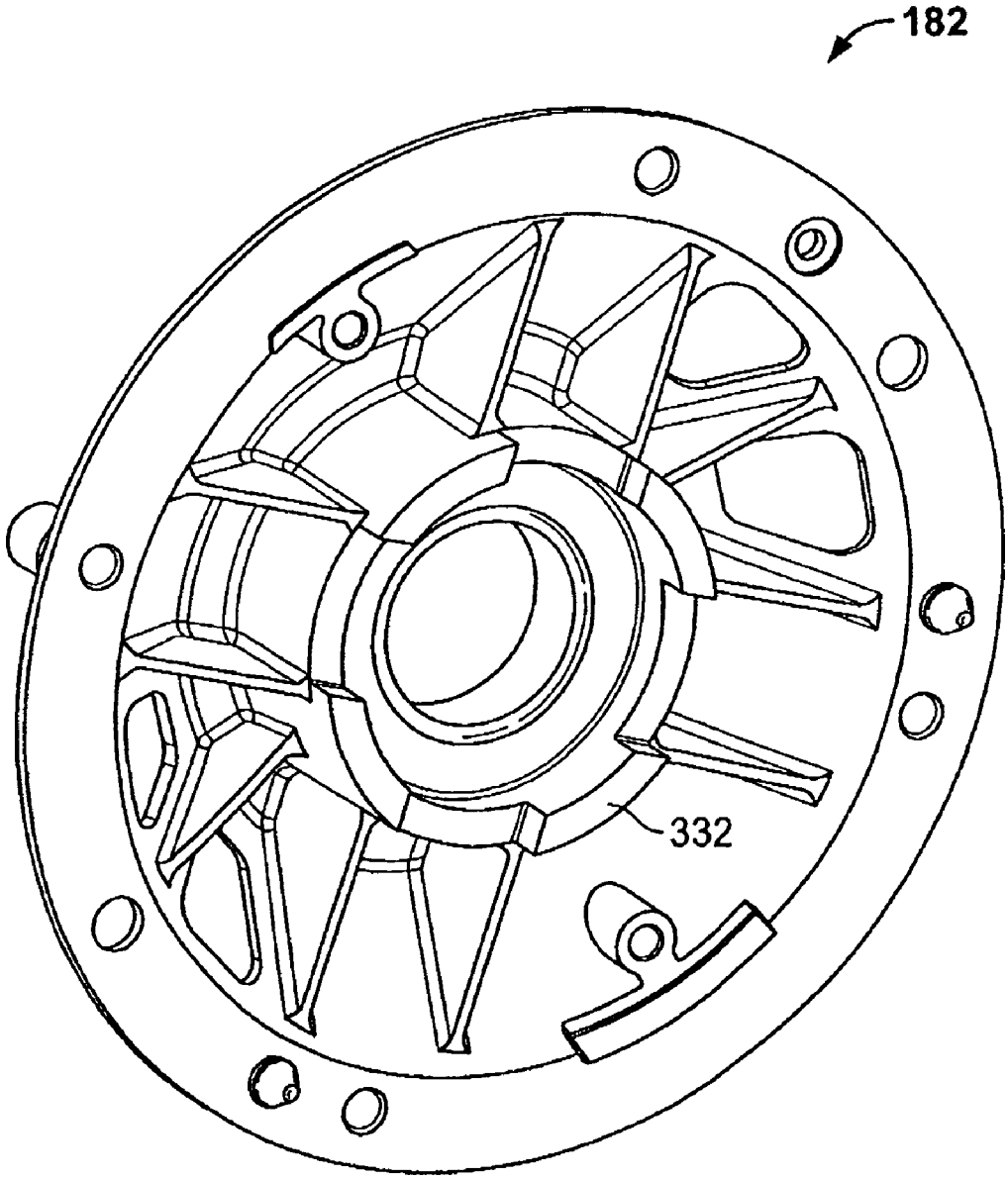
FIG. 5 is a perspective view of the bearing retainer assembly shown in FIG. 4.

FIG. 4 is an exploded perspective view of mode shifter 178 coupled to drive pulley 176 and a shaft assembly 300. Specifically, shaft assembly 300 includes an agitator shaft 302, a spin tube 304, and bearing retainer assembly 182, as is shown in FIG. 5. Mode shifter 178 includes a solenoid 306, a clutch 308, a spring 310, and a washer 312. Solenoid 306 includes a bracket assembly 314 and an armature assembly 316.

Figure 6:
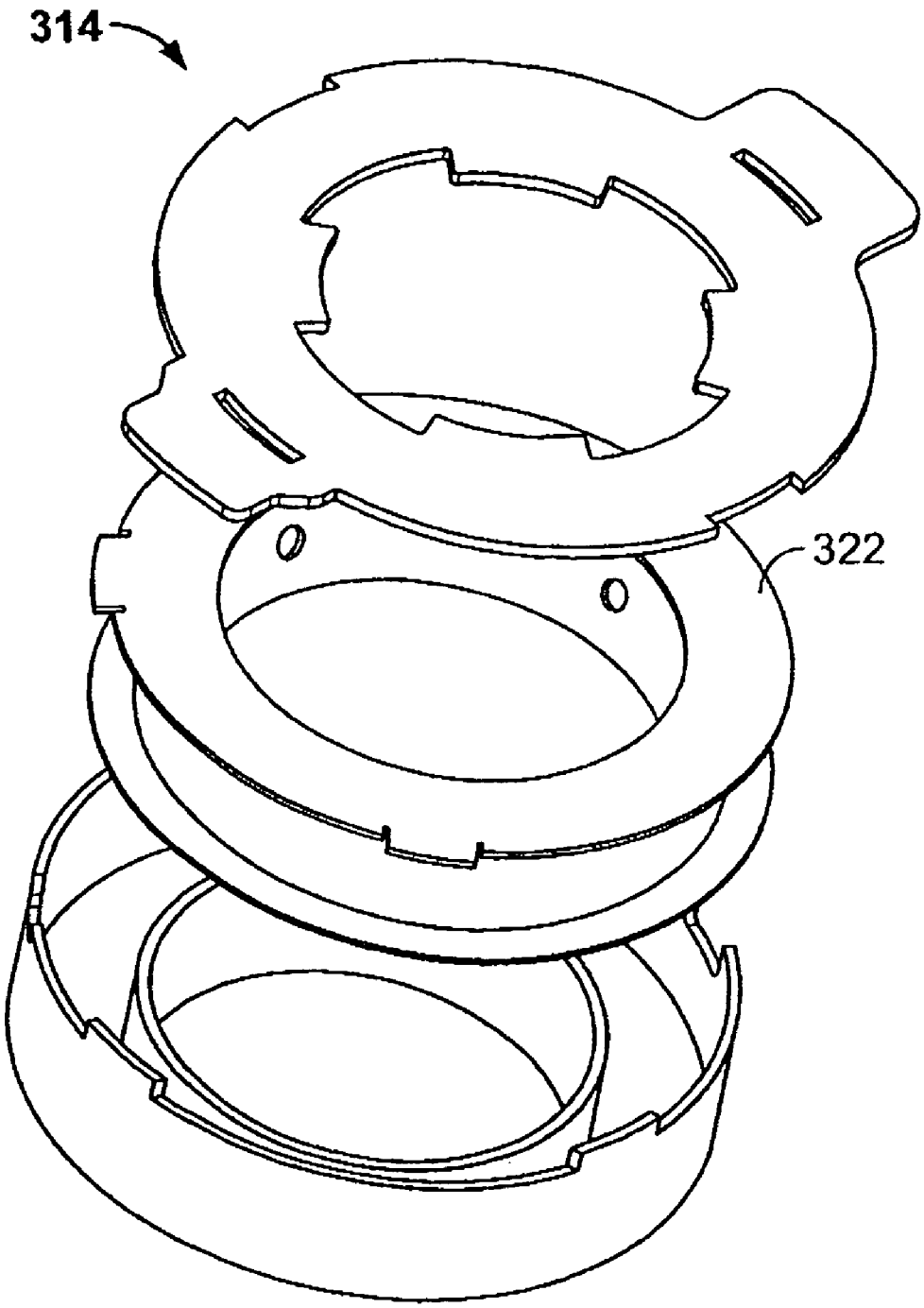
FIG. 6 is a perspective view of the bracket assembly shown in FIG. 4.

Drive pulley 176 is coupled to agitator shaft 302, which extends through spin tube 304 and is movable with respect to spin tube 304. In this embodiment, a spacer armature 318 and a retaining ring 320 are coupled between drive pulley 176 and agitator shaft 302. Agitator shaft 302 is coupled to agitator 120 and spin tube 304 is coupled to basket 70. Bearing retainer assembly 182 is positioned circumferentially around spin tube 304 and is coupled within washing machine 50. Bearing retainer assembly 182 includes dogs or other suitable projections for retaining basket 70 properly positioned during the agitation mode. Bearing retainer assembly 182 is also coupled to solenoid bracket assembly 314, which includes an inductive coil 322 positioned therein, as shown in FIG. 6.

Figure 7:
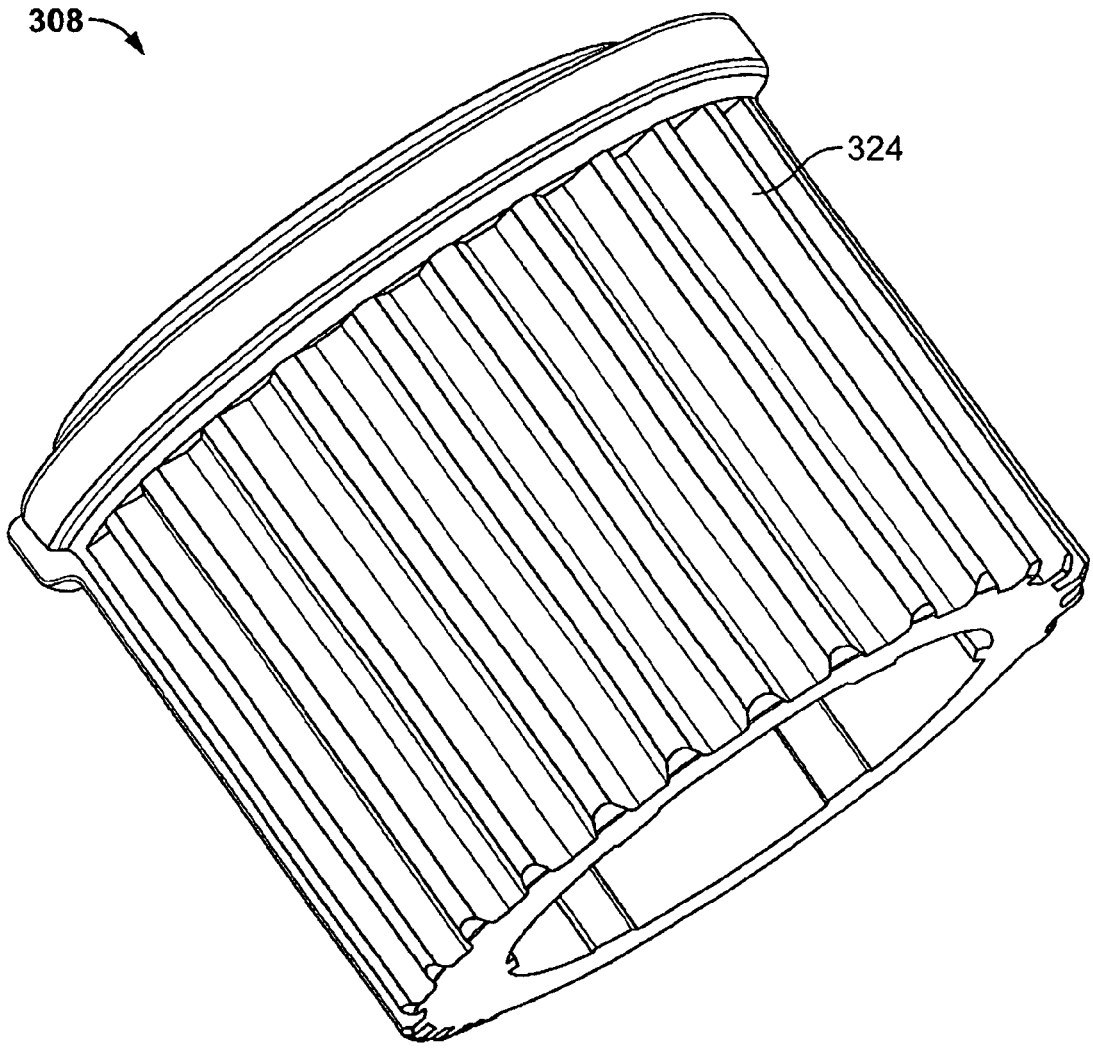
FIG. 7 is a perspective view of the clutch shown in FIG. 4.
Figure 8:
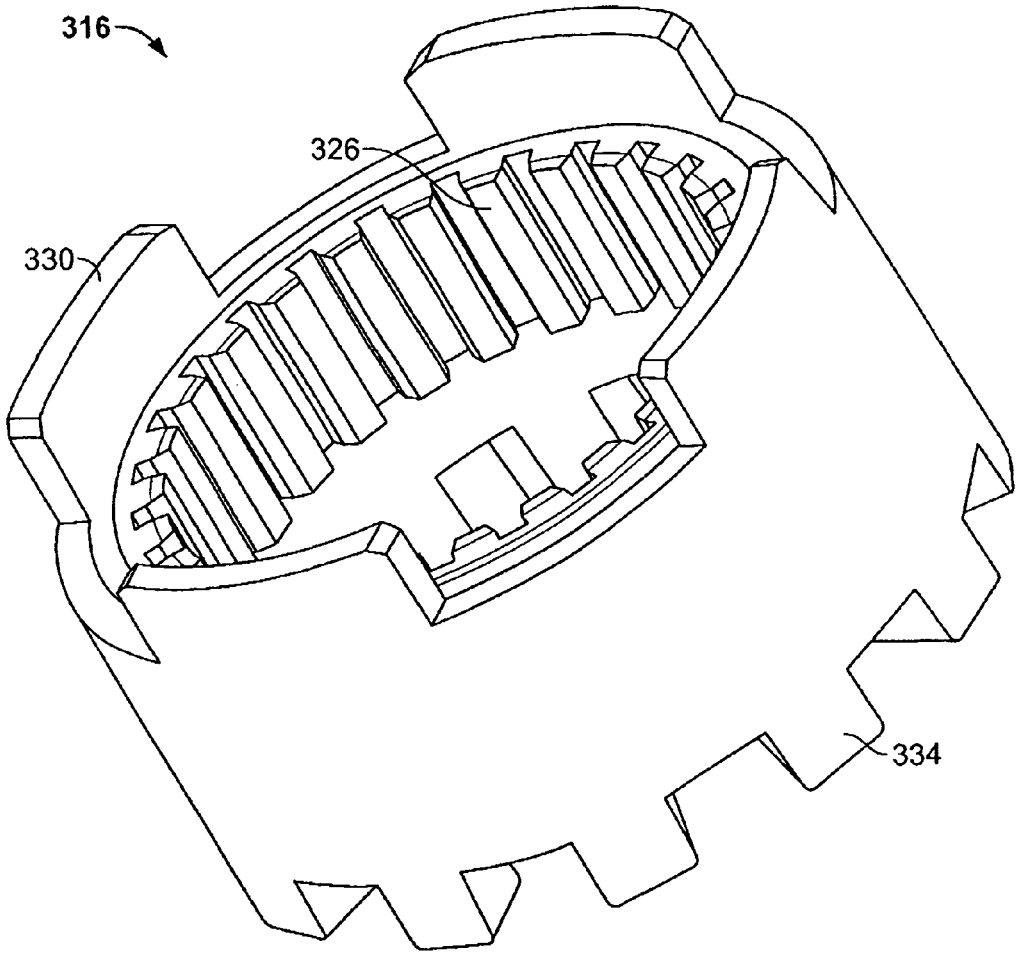
FIG. 8 is a perspective view of the armature assembly shown in FIG. 4.

Clutch 308 is coupled to spin tube 304 and armature assembly 316. In one embodiment, a plurality of splines 324 formed on an outer surface of clutch 308, as shown in FIG. 7, engage or interfere with a plurality of splines 326 formed on an inner surface of armature assembly 316, as shown in FIG. 8. Splines 324 and splines 326 are engaged such that armature assembly 316 can slide between an upper position and a lower position. Specifically, armature assembly 316 is positioned within a bore 328 formed in bracket assembly 314 such that energizing and deenergizing an inductive current in inductive coil 322 causes armature assembly 316 to slide along clutch 308 between the upper position and the lower position.

Figure 9:
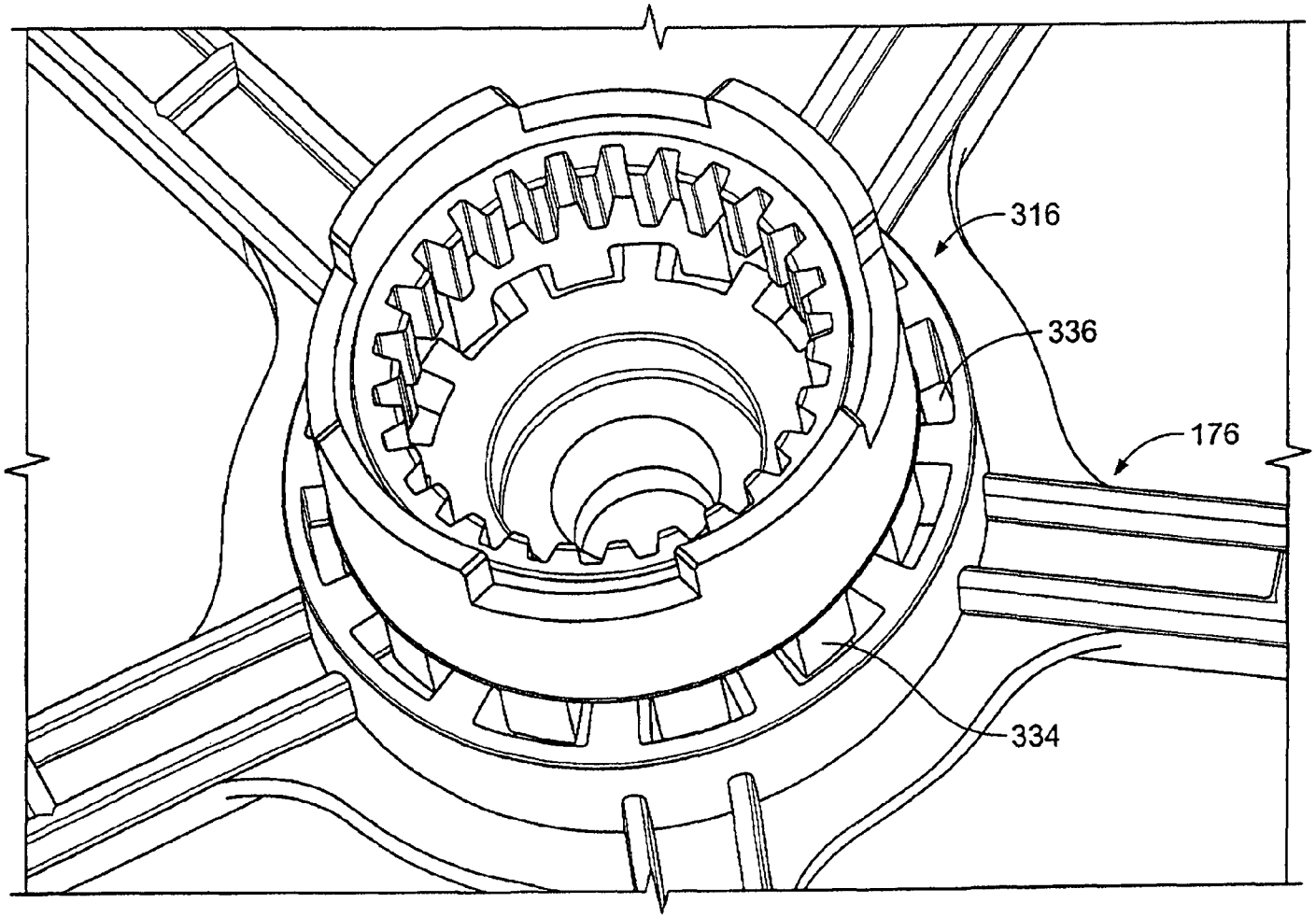
FIG. 9 is a perspective view of the armature assembly shown is FIGS. 4 and 8 coupled to the drive pulley shown in FIG. 4.

With inductive coil 322 energized, armature assembly 316 is in the upper position. In the upper position, armature assembly 316 is configured to couple to bearing retainer assembly 182. Specifically, a plurality of teeth 330 formed on armature assembly 316, as shown in FIG. 8, are configured to engage or cooperate with a plurality of teeth 332 formed on bearing retainer assembly 182, as shown in FIG. 5. With inductive coil 322 deenergized, armature assembly 316 moves into the lower position. In the lower position, a plurality of teeth 334 formed on armature assembly 316, as shown in FIG. 8, engage or cooperate with a plurality of notches 336 formed in drive pulley 176, as shown in FIG. 9. Washer 312 and spring 310 are coupled between armature assembly 316 and clutch 308 for facilitating movement of armature assembly 316 with respect to clutch 308. Specifically, spring 310 is configured to provide a resistant force against armature assembly 316 as armature assembly 316 moves into the upper position.

In one embodiment, during operation of washing machine 50, solenoid 306 is energized by motor controller 190. In the energized state, armature assembly 316 is in the upper position. In the upper position, armature assembly 316 is disengaged from drive pulley 176 and engaged with bearing retainer assembly 182. As such, bearing retainer assembly 182 prevents armature assembly 316 from rotating such that basket 70 does not rotate. Motor controller 190 powers motor 170 causing drive pulley 176 to rotate. The rotation of drive pulley 176 rotates agitator shaft 302 such that only agitator 120 rotates when solenoid 300 is energized, referred to herein as the agitation mode for washing machine 50.

When the spin mode of washing machine 50 is required, motor controller 190 deenergizes solenoid 306 causing armature assembly 316 to slide into the lower position. In the lower position, armature assembly 316 is engaged with drive pulley 176. Drive pulley 176 rotates to rotate agitator shaft 302 causing agitator 120 to rotate. Because armature assembly 316 is engaged with drive pulley 176, armature assembly 316 also rotates causing clutch 308 to rotate. The rotation of clutch 308 causes spin tube 304 and basket 70 to rotate such that agitator 120 and basket 70 rotate together in the spin mode.

As described above, in one embodiment, washing machine 50 operates in a spin mode when solenoid 306 is deenergized, and operates in an agitation mode when solenoid 306 is energized. In an alternative embodiment, washing machine 50 operates in a spin mode when solenoid 306 is energized, and operates in an agitation mode when solenoid 306 is deenergized.

Figure 10:
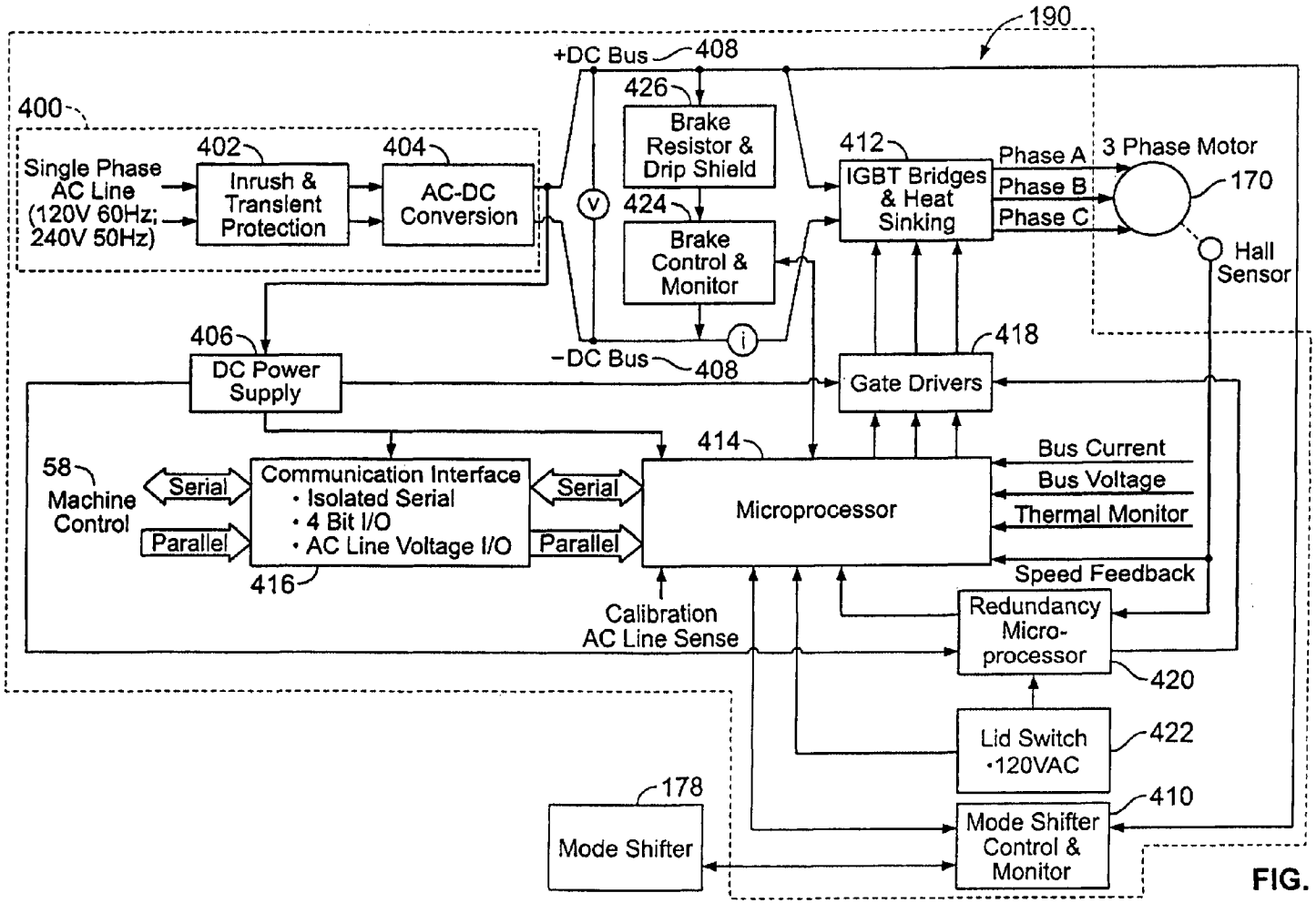
FIG. 10 is an electrical schematic block diagram of the motor controller shown in FIG. 2 electrically coupled to the motor and the mode shifter.

FIG. 10 is an electrical schematic block diagram of motor controller 190 electrically coupled to motor 170 and mode shifter 178. In one embodiment, motor controller 190 includes a power inlet 400 including an inrush and transient protection component 402 and an AC/DC converter 404. AC/DC converter 404 converts a single phase AC line to direct current. A portion of the direct current is stored in a DC power supply 406, and a portion of the direct current is channeled to a direct current bus 408. Direct current bus 408 is electrically coupled to a mode shifter control and monitor 410, which is coupled to and controls mode shifter 178. Direct current bus 408 is also electrically coupled to insulated gate bipolar transistors (IGBT) 412, which convert the direct current into a synthetic AC voltage known as pulse width modulation. In this embodiment, the pulse width modulation is used to power motor 170.

Motor controller 190 also includes a microprocessor 414 that is powered by DC power supply 406 and operated by a communications interface 416 that is electrically coupled to washing machine control board assembly 58. Microprocessor 414 also operates a gate driver 418 which is powered by DC power supply 406 and provides an electrical interface between microprocessor 414 and IGBT 412. Gate driver 418 also functions to provide a hardware trip current limit for washing machine 50. As such, microprocessor 414 controls the pulse width modulation pattern based on factors including, but not limited to, speed reference, tachometer feedback, DC link current, and/or DC link voltage. Further, microprocessor 414 monitors a heat sink temperature of motor controller 190.

Moreover, microprocessor 414 monitors and operates with a redundancy microprocessor 420, a lid switch 422, and a brake control 424 including a brake resistor and drip shield 426. Lid switch 422 is configured to stop operation of washing machine 50 when the lid is open. Specifically, operation of washing machine 50 is stopped by brake control 424. Brake control 424 also stops washing machine 50 when the hardware trip current limit of gate driver 418 is exceeded. In addition, microprocessor 414 monitors and operates mode shifter control and monitor 410 to operate mode shifter 178.

In one embodiment, mode shifter 178 is coupled to direct current bus 408. As such, only a necessary amount of power is channeled to mode shifter 178. Specifically, mode shifter 178 requires a first amount of power to become energized. After mode shifter 178 is energized, a second amount of power is required to maintain the energized state. In one embodiment, the first amount of power is greater than the second amount of power. Thus, mode shifter 178 receives a larger amount of power while being energized than an amount of power needed to maintain mode shifter 178 in the energized state. By reducing the amount of power channeled to mode shifter 178 after mode shifter 178 is energized, an amount of heat generated by mode shifter 178 is reduced.

In one embodiment, a method for assembling a washing machine is provided. The method includes providing a mode shifter including a solenoid, coupling a basket and an agitator to the mode shifter, and coupling a motor to the mode shifter. The solenoid selectively allows the motor to rotate the basket and/or the agitator. The method also includes affixing a motor controller to the motor, and electrically coupling the motor controller to each of the mode shifter and the motor. The motor controller is in operational control communication with the mode shifter and the motor.

The above-described system for powering a mode shifter of a washing machine allows a motor controller to be affixed to a motor and electrically coupled to both the motor and the mode shifter. More specifically, the system facilitates efficiently and cost-effectively coupling components of a washing machine thereby reducing an amount of wire used in the washing machine. Further, the system facilitates powering the mode shifter with a direct current voltage such that the mode shifter only receives a necessary amount of power and avoids overheating. As a result, a more efficient and more easily maintainable washing machine is provided.

Exemplary embodiments of a method and an apparatus for controlling a mode shifter for a washing machine are described above in detail. The method and apparatus are not limited to the specific embodiments described herein, but rather, steps of the method and/or components of the apparatus may be utilized independently and separately from other steps and/or components described herein. Further, the described method steps and/or apparatus components can also be defined in, or used in combination with, other methods and/or apparatus, and are not limited to practice with only the method and apparatus as described herein.

As used herein, an element or step recited in the singular and proceeded with the word "a" or "an" should be understood as not excluding plural elements or steps, unless such exclusion is explicitly recited. Further, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. A method for assembling a washing machine, said method comprising:

providing a mode shifter including a solenoid;

coupling a basket and an agitator to the mode shifter;

coupling a motor to the mode shifter, the solenoid selectively allowing the motor to rotate at least one of the basket and the agitator by deenergizing or energizing the solenoid;

independently electrically coupling a motor controller to each of the mode shifter and the motor, the motor controller in operational control communication with the mode shifter and the motor, wherein energizing the solenoid couples the motor only to the agitator and deenergizing the solenoid couples the agitator and the basket to the motor; and coupling a control board assembly to the motor controller such that input into the control board assembly to operate the washing machine is sent through the motor controller to facilitate an operation of the mode shifter and the motor.

2. A method in accordance with claim 1 wherein said electrically coupling the motor controller to the mode shifter comprises electrically coupling the motor controller to energize the solenoid during a first washing machine mode and deenergize the solenoid during a second washing machine mode different from the first washing machine mode.

3. A method in accordance with claim 1 wherein selectively activating the motor to rotate at least one of the basket and the agitator comprises rotating the agitator, while maintaining the basket stationary, during a first washing machine mode and rotating the agitator and the basket during a second washing machine mode different from the first washing machine mode.

4. A method in accordance with claim 1 wherein electrically coupling the motor controller to the mode shifter comprises coupling a direct current power source to the mode shifter for facilitating providing a pulse width modulated current to the mode shifter to facilitate providing only a necessary amount of power to the mode shifter and reducing heat generated within the mode shifter.

5. A method in accordance with claim 1 wherein electrically coupling the motor controller to the mode shifter comprises electrically coupling the motor controller to provide a pulse width modulated current to the mode, shifter such that a first amount of power energizes the solenoid to an energized state and a second amount of power maintains the energized state, the first amount of power greater than the second amount of power.

6. A method in accordance with claim 1 wherein electrically coupling the motor controller to the mode shifter comprises coupling a direct current bus to the mode shifter, the direct current bus configured to provide a pulse width modulated current to the mode shifter.

7. A method in accordance with claim 1, wherein coupling the agitator and the basket to the motor by deenergizing the solenoid comprises coupling an armature assembly to a drive pulley such that a rotation of the drive pulley rotates the agitator and the basket.

8. A method in accordance with claim 7, wherein coupling the motor only to the agitator by energizing the solenoid comprises decoupling the armature assembly from the drive pulley and coupling the armature assembly to a bearing retainer assembly such that a rotation of the basket is prevented when the drive pulley rotates.

9. A washing machine comprising:

a mode shifter including a solenoid;

a basket and an agitator coupled to said mode shifter;

a motor coupled to said mode shifter, said solenoid selectively allowing said motor to rotate at least one of said basket and said agitator;

a motor controller independently electrically coupled to each of said mode shifter and said motor, said motor controller configured to control operation of said mode shifter and said motor, said motor controller configured to control operation of said mode shifter by energizing or deenergizing said solenoid, wherein energizing said solenoid couples said motor only to said agitator and deenergizing said solenoid couples said agitator and said basket to said motor; and a control board assembly communicatively coupled to the motor controller such that input into the control board assembly to operate the washing machine is sent through the motor controller to facilitate an operation of the mode shifter and the motor.

10. A washing machine in accordance with claim 9 wherein said motor controller energizes said solenoid during a first washing machine mode and said motor controller deenergizes said solenoid during a second washing machine mode different from the first washing machine mode.

11. A washing machine in accordance with claim 9 wherein said motor rotates said agitator during a first washing machine mode and rotates said agitator and said basket during a second washing machine mode different from the first washing machine mode.

12. A washing machine in accordance with claim 9 wherein said motor controller further comprises a direct current power source coupled to said mode shifter, said direct current power source configured to provide a pulse width modulated current to said mode shifter to limit an amount of power to said mode shifter and reduce an amount of heat generated by said mode shifter.

13. A washing machine in accordance with claim 9 wherein said motor controller provides a pulse width modulated current to said mode shifter such that a first amount of power energizes said solenoid to an energized state and a second amount of power maintains said solenoid at the energized state, the first amount of power greater than the second amount of power.

14. A washing machine in accordance with claim 9 wherein said motor controller further comprises a direct current bus coupled to said mode shifter, said direct current bus configured to provide a pulse width modulated current to said mode shifter.

15. An electronic configuration for a washing machine, said electronic configuration comprising:

a mode shifter including a solenoid, said mode shifter coupled to each of a basket and an agitator;

a motor coupled to said mode shifter, said solenoid selectively allowing said motor to rotate at least one of the basket and the agitator;

a motor controller independently electrically coupled to said mode shifter and said motor, said motor controller configured to control operation of said mode shifter and said motor, said motor controller configured to control operation of said mode shifter by energizing or deenergizing said solenoid, wherein energizing said solenoid couples said motor only to the agitator and deenergizing said solenoid couples the agitator and the basket to said motor; and a control board assembly communicatively coupled to the motor controller such that input into the control board assembly to operate the washing machine is sent through the motor controller to facilitate an operation of the mode shifter and the motor.

16. An electrical configuration in accordance with claim 15 wherein said motor controller energizes said solenoid during a first washing machine mode and said motor controller deenergizes said solenoid during a second washing machine mode different from the first washing machine mode.

17. An electrical configuration in accordance with claim 15 wherein said motor rotates only the agitator during a first washing machine mode and said motor rotates the agitator and the basket during a second washing machine mode different from the first washing machine mode.

18. An electrical configuration in accordance with claim 15 wherein said motor controller further comprises a direct current power source coupled to said mode shifter, said direct current power source configured to provide a pulse width modulated current to said mode shifter to limit an amount of power to said mode shifter and reduce an amount of heat generated by said mode shifter.

19. An electrical configuration in accordance with claim 15 wherein said motor controller provides a pulse width modulated current to said mode shifter such that a first amount of power energizes said solenoid to an energized state and a second amount of power maintains said solenoid in the energized state, the first amount of power greater than the second amount of power.

20. An electrical configuration in accordance with claim 15 wherein said motor controller further comprises a direct current bus electrically coupled to said mode shifter, said direct current bus configured to provide a pulse width modulated current to said mode shifter.

* * * * *